United States Patent [19]

Maul, Sr.

[11] 4,324,181

[45] Apr. 13, 1982

[54] IMPRINTER WITH PLURAL SELECTIVELY OPERATING PLATEN ROLLERS

[75] Inventor: John A. Maul, Sr., Lyndhurst, Ohio

[73] Assignee: DBS, Inc., Randolph, Mass.

[21] Appl. No.: 106,851

[22] Filed: Dec. 26, 1979

[51] Int. Cl.[3] ..... B41F 3/04

[52] U.S. Cl. ..... 101/269

[58] Field of Search ..... 101/269–274, 101/45

[56] References Cited

U.S. PATENT DOCUMENTS

| | | | |
|---|---|---|---|
| 3,388,660 | 6/1968 | Wight | 101/269 |
| 3,750,569 | 8/1973 | Janik | 101/269 |
| 3,780,669 | 12/1973 | Geiger et al. | 101/269 |
| 3,810,424 | 5/1974 | Barbour | 101/269 |
| 3,862,598 | 1/1975 | Hawthorne | 101/269 |
| 3,954,056 | 5/1976 | Barbour | 101/269 |

FOREIGN PATENT DOCUMENTS

| | | | |
|---|---|---|---|
| 2232929 | 1/1975 | France | 101/269 |

*Primary Examiner*—Edward M. Coven

*Attorney, Agent, or Firm*—Gerald J. Ferguson, Jr.; Joseph J. Baker

[57] ABSTRACT

Imprinters for making printed impressions from tokens such as credit cards are provided in which the carriage which traverses the bed of the imprinter includes two independent roller platen mechanisms. Translation means responsive to travel of the platen along the bed at certain points causes the platen rollers to be raised to nonprinting position or lowered to printing position. The mechanism also includes a transition device which makes it possible to convert the imprinter from a condition in which the platen rollers are raised and lowered in concert to one in which the raised condition of one roller occurs when the other is lowered and vice versa. In the illustrated form the translation devices include interacting cam members, one set for each platen roller, and the transition device is shown as being one of the cam members which can occupy alternate positions in the assembly. There is also disclosed mechanism comprising an actuating cage moving transversely of the carriage path in response to encountering actuating cams along said path to effect motion of the translation cam members.

8 Claims, 7 Drawing Figures

IMPRINTER WITH PLURAL SELECTIVELY OPERATING PLATEN ROLLERS

BACKGROUND OF THE INVENTION

This invention relates to devices for taking printing impressions from tokens or printing members with raised characters such as credit cards and the like, and such devices are commonly referred to as imprinters. Imprinters have been in use for many years and often consist of a flat bed provided with means to receive and locate the token, and other means to properly position a form overlying the token or card. A roller platen mounted on a carriage which travels along the bed is arranged to move over the printing location after the card and form are in place, and is accurately spaced from the bed so as to provide the correct amount of interference with the card and form, thereby generating the desired printing pressure.

It is conventional to have the imprinter make impressions from more than one token during the printing pass. For example, it is quite customary to have on the imprinter bed, a semipermanent printing element, frequently termed a station plate, for identifying the location, branch, store or other outlet where the impression is being made. Often imprinters also include permanent installations of settable variable wheels which can be adjusted to print other desired information such as the date of a transaction, a money amount or the like.

At the outset the purpose of the imprinter was to provide a clear, visually readable impression of the characters and thus, in addition to saving writing time, avoid the complications introduced by the need to interpret handwritten forms, and to this end an early development included translation mechanism for automatically raising the platen on its return stroke so that the impression would not be blurred by a second slightly offset impression. A device representative of this type of operation is shown in U.S. Pat. No. 3,018,725.

With advancing technology providing higher levels of automation in the areas of sensing devices, it became more and more important for the imprinter to provide an even higher level impression which was not only visually legible but also complete and accurate enough to be read by automatic sensing equipment in the nature of MICR and OCR devices and to do so with an acceptably low error rate.

One approach to this goal involved the concept that impression results could be improved if the impression of a critical portion of the data characters (usually the part which was required to be automatically read) could be generated by one pass of the platen in contact solely with the critical portions of the data characters, usually located along one print line and destined for automatic sensing, while the non-critical data characters would be imprinted on a separate pass. In this way the pressure values experienced by the platen during the critical pass would be fairly standard and uniform throughout the critical impression and would be undisturbed by possibly conflicting pressure demands which might be made by the remaining characters on parallel print lines of varying lengths.

The foregoing results have been achieved in prior devices in some cases by having a short roller platen so arranged that it can shift from a first axial position where it sweeps the critical data areas on a first pass of the carriage, to a second axial position where it sweeps the remaining data areas on a second pass of the carriage. This form is illustrated in U.S. Pat. No. 3,577,917. In other cases as illustrated by U.S. Pat. No. 3,272,120, the carriage has been provided with two platens each of which is lined up with one of the print areas, i.e. with one of the sets of data characters, and then the platens are caused to be alternately raised and lowered by translation mechanisms as the carriage is moved, usually in dependence upon carriage location or the direction of carriage movement, to determine which set of data is to be imprinted during a particular pass.

SUMMARY OF THE INVENTION

The imprinters of the prior art have either been constructed so as to be capable of providing an impression of all data characters on the bed at one pass, or to make selective impressions so that two passes are required to imprint the entire message. No equipment has been available which had the capability of being readily converted from a full frame single pass imprinter to a selective plural pass imprinter, and vice versa.

The present invention takes care of supplying this convertable capability in a single device so that the owner and user has more flexibility in how his imprinters are deployed, and requires many fewer extras for servicing requirements in cases where both types are being employed. In addition the manufacturer can simplify his procedures by having one standard line which can be used to serve all customers, whichever type may be desired.

The present invention achieves this convertibility by having the carriage so arranged that it can support two independent platen carriers for up and down movement, the carriers being so arranged that the platen carried by each will sweep a distinct predetermined area of the bed. Translation mechanism comprising a pair of coacting cam elements is associated with each carrier for raising and lowering the same relative to the bed and carriage. One of the cam elements is, for practical purposes, fixed upon the carriage (or upon the platen carrier), while the other or intermediate cam element is shiftable between the fixed cam element and the cooperating surface on the associated platen carrier (or a cooperating surface on the carriage) to cause camming of the carrier and its platen towards and away from the bed. The intermediate cam elements are actuated by being drivingly associated with an actuator member which causes the intermediate cam elements to shift location at the desired time. For example a cam fixed upon the imprinter bed can be so positioned as to cause actuator shifting whenever the carriage arrives at a certain position along the bed.

In order to provide convertibility to the device the cam lobes on the intermediate or fixed cam elements can be designed so that changing a portion of the cam system will cause the cams to act either alternately or simultaneously. In the preferred form of the invention the cam system is so designed that changing of the parts is unnecessary, and the cam lobes are so located that the intermediate cam element relating to one of the platens can be turned end-for-end to serve as a transition device selectively dictating either one type of operation or the other.

DESCRIPTION OF THE DRAWING FIGURES

DESCRIPTION OF THE PREFERRED EMBODIMENT

Figure 1:
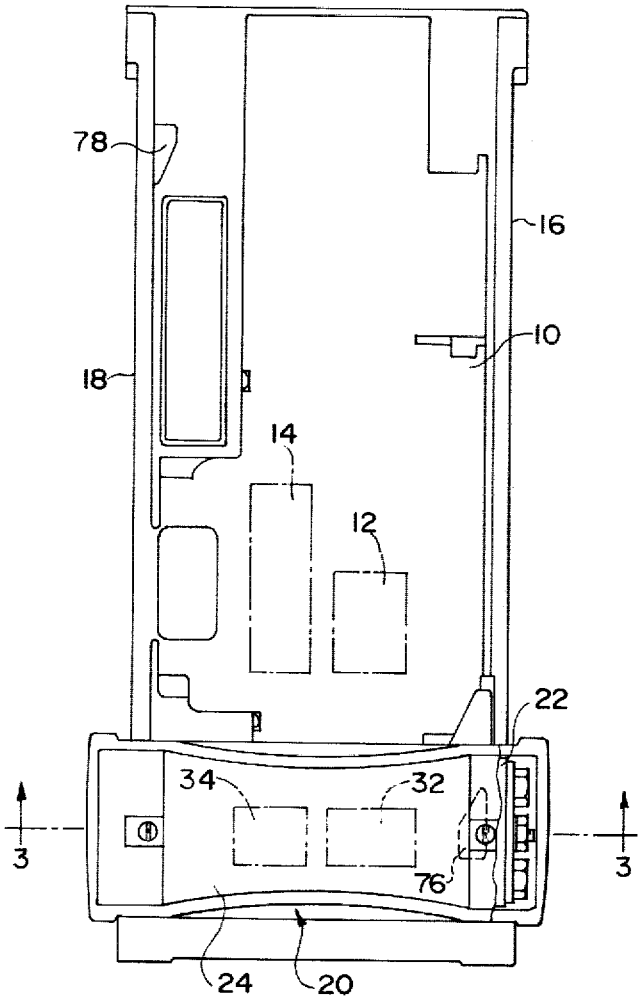
FIG. 1 is a top plan of an imprinter according to the invention, with portions broken away.
Figure 2:
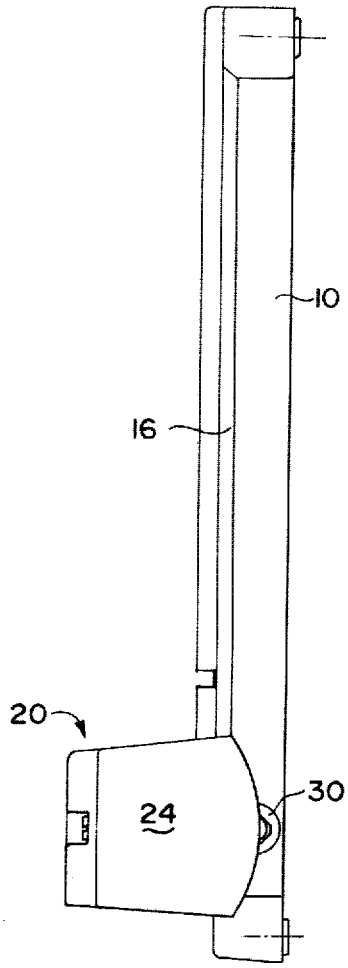
FIG. 2 is a front elevation of the imprinter of FIG. 1.

Referring to FIGS. 1 and 2, an imprinter is shown comprising a base or bed 10 which carries the printing elements which will be used to make impressions on a form. In the particular example shown the bed is designed to carry a station plate with a printing area such as that diagrammatically indicated at 12, and a removable credit card whose printing area will lie in an area diagrammatically indicated at 14.

Each of the long margins of the base 10 is provided with a track designated respectively 16 and 18, and a carriage 20 is designed to roll along the tracks 16 and 18 to be carried across the bed, first in one direction and then the other. The carriage comprises a frame 22 and a shroud 24 which serves as a handle to operate the carriage during printing.

Figure 3:
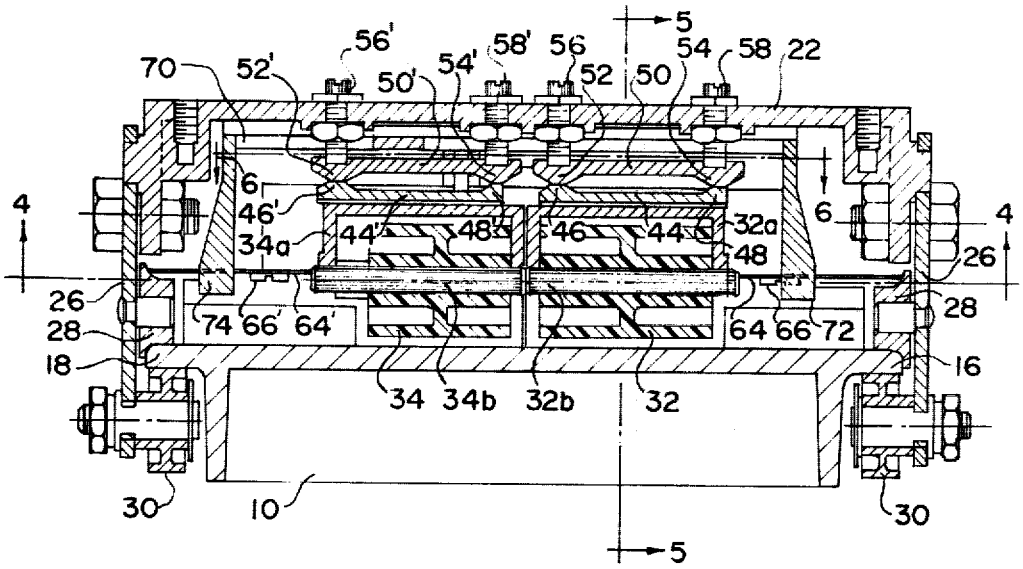
FIG. 3 is a section, to a larger scale, taken substantially on line 3—3 of FIG. 1 but with the handle portion or shroud of the carriage removed.
Figure 4:
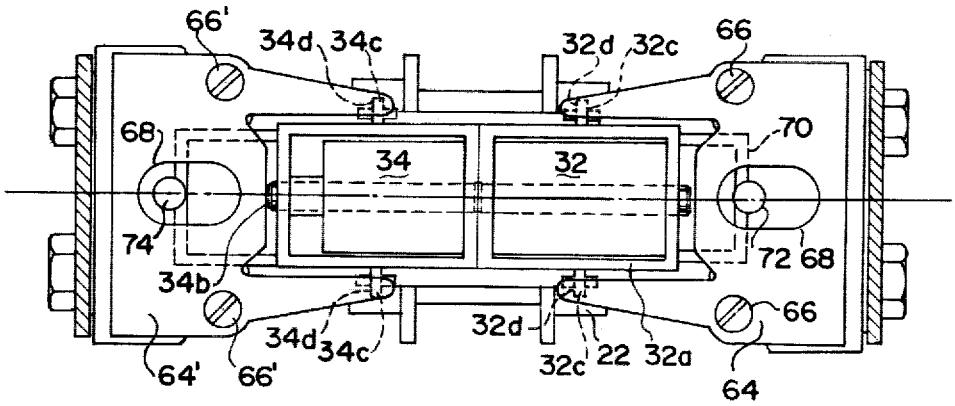
FIG. 4 is a horizontal section taken substantially on line 4—4 of FIG. 3, but showing the platens, platen carriers, and cam follower projections unsectioned.
Figure 5:
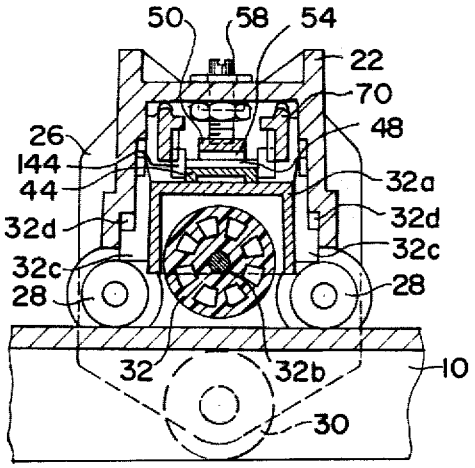
FIG. 5 is a vertical section taken substantially on line 5—5 of FIG. 3.

The carriage frame 22 is shown in greater detail in FIGS. 3, 4 and 5, and has attached to each end a support plate 26 each of which has a pair of upper wheels 28, 28, and a lower wheel 30 for supporting the frame above the bed and guiding it along the tracks 16 and 18.

The carriage frame's primary function is to carry a pair of roller platens designated 32 and 34 which will cooperate with the printing elements appearing in the areas designated 12 and 14 respectively. The platen 32 is mounted for rotation in an individual platen carrier 32*a* by means of a horizontal shaft 32*b*. The carrier 32*a* is permitted to raise and lower with respect to the frame 22 and is held in proper alignment with a predetermined path along the bed by ears 32*c* which are slidingly received in vertical frame slots 32*d* (FIG. 5). The platen carrier for platen 34 is designated 34*a*, and the associated parts and cooperating features are designated 34*b*, 34*c*, and 34*d* similarly to those for platen 32.

The control and adjusting mechanism for the platens is carried generally above the platen carriers 32*a* and 34*a* and comprises essentially translation mechanism embodying a pair of cam systems, one for each platen, controlling the raising and lowering motion thereof, each cam system including a pair of interacting cam members. The upper surface of each cam system is in engagement with abutments adjustably carried by the frame 22 for a purpose which will be presently described.

The cam system and abutments will be described in detail for platen 32 with the understanding that the corresponding elements serving platen 34 are similarly referenced but include a prime designation.

The cam system for platen 32 comprises a horizontally slidable cam member 44 resting upon the upper surface of the platen carriage 32 with two upwardly directed cam lobes 46 and 48. Above the slidable cam member is a cam member 50 which is considered fixed in the sense that it is constrained against horizontal movement, and has downwardly facing cam lobes 52 and 54 designed for coaction with the cam lobes of the slidable cam member 44. The upper surface of the fixed cam member is associated with two abutment screws 56, 58 whose degree of projection downwardly from the upper element of the frame 22 can be adjustably set and clamped. For the purpose of maintaining the fixed cam member 50 in its designated horizontal location, its upper surface is preferably provided with smooth-bore sockets 60, 62 (FIG. 6) which snugly and rotatably receive the unthreaded ends of the adjustable abutment screws.

The stack of elements starting with the platen carrier 32*a* with its platen 32 and proceeding upwardly to the fixed cam member 50 are all continuously urged upwardly against the adjustable abutments by a leaf spring member 64 which is secured by fasteners 66 to the carriage frame 22, and is best seen in FIG. 4. This member is a U-shaped plate whose two spring fingers press upwardly upon the platen carrier 32*a*, particularly the bottom ends of the ears 32*c* thereof, and thereby hold all of the elements of the stack in contact, and in the most upwardly position permitted by the circumstances.

From a study of FIG. 3 it can be seen that the lobes on the cam members are in mutual contact. That is to say, lobe 46 is opposing lobe 52 and lobe 48 is opposing lobe 54. Similarly lobe 46' is opposing lobe 52' and lobe 48' is opposing lobe 54'. This means that both platens 32 and 34 are in their lowermost or printing positions, forced there by the cam systems acting in opposition to the upward pressure of spring 64 and 64'.

In order to secure reliable printing action, the platens 32 and 34 must have their surface elements precisely parallel to the bed 10, and the clearance between the bed platens and the bed 10 must be set very accurately to a predetermined value which is determined by the height of the type being used and the thickness of the forms designed for use with the imprinter. Adjustable abutments comprising screws 56, 58 and 56', 58' are used to make these settings. The reason for providing two adjusting screws for each platen (together with a set of opposing cam lobes for each screw) will now be apparent inasmuch as two reaction points are preferable in order to give the angular motion needed to bring the platens and their shafts into exact parallelism with the bed surface.

As previously mentioned, in FIG. 3 shows both platens 32 and 34 to be in printing position simultaneously. In order to raise both platens to nonprinting position it is necessary to shift the slidable cam members 44 and 44' to the right in FIG. 3 thereby moving the lobes of the movable cam members out of register with the lobes of the fixed cam members, which action allows the platen carriers 32*a* and 34*a* to rise under the influence of springs 64 and 64'.

Figure 6:
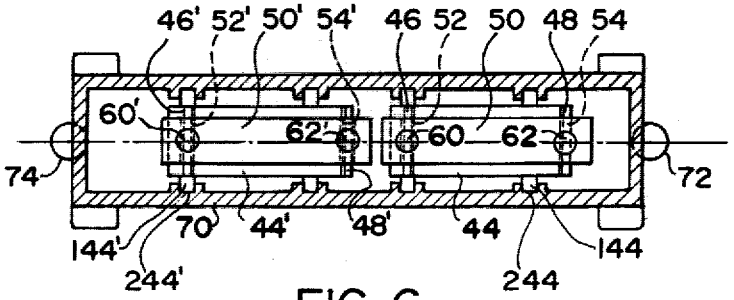
FIG. 6 is a horizontal section taken substantially on line 6—6 of FIG. 3.

Shifting of the slidable cam members occurs in response to movement of an actuator member in the form of a shifting cage 70 which can be seen in FIG. 6 where it is shown in horizontal section looking from the top. The body of the cage 70 is located between the upper surface of the platen carriers 32*a* and 34*a* and the under surface of the top plate of the carriage frame 22, and is designed to straddle the cam system and adjusting screws (as seen in FIG. 5). However, each end of the cage has a depending leg which extends down to ride upon the upper surface of the spring plate 64 or 64'. Associated with each depending leg is a cylindrical cam follower projection which projects further downwardly through an opening 68 in the corresponding spring plate. Each projection extends downwardly sufficiently to be within range of an actuating cam on the bed 10, the projection 72 at the right side of the shifting cage in FIGS. 3 and 4 being designed for coaction with a cam 76 (FIG. 1), and the projection 74 being designed for coaction with a cam 78 (FIG. 1).

When the shifting cage moves, it carries along with it the slidable cam members 44 and 44'. This operation results from the fact that the cam members include ears, 144 and 144' respectively, arranged to be trapped and vertically slidable within corresponding slots 244 and 244' formed on the interior surfaces of cage 70. This arrangement permits the cage to drive the intermediate or slidable cam members in response to cage motion, and at the same time to be free of constraint in a vertical direction so that the slidable cam members can follow whatever slight vertical motion is associated with the adjusting action of the screws 56, 58 and 56', 58'.

With a machine assembled in the manner thus far described, it will be understood that with the parts arranged as shown in FIGS. 1 and 2, the imprinter is in ready position with both platens lowered. As the platen carriage 20 is moved away from its home position, the platens move across areas 12 and 14, causing printing impressions, corresponding to any type elements located in those areas, to be made upon an intervening form in corresponding areas thereof. As the carriage is moved further down the bed, the cam 78 will make contact with the follower projection 74 on cage 70, thereby causing the same to shift to the right, offsetting all of the cam lobes and allowing the spring plates 64, 64' to raise both of the platen carriers. As the carriage 20 is returned to home position, therefore, the platens will both be raised and no impression will occur. Finally as the platen reaches home position, the other cam follower projection 72 will strike cam 76 thereby shifting the cage 70 and the intermediate or sliding cam members back into a position such that the cam lobes are again aligned. The platens are thus lowered again to printing position and the imprinter is in readiness for another cycle of operation.

Figure 7:
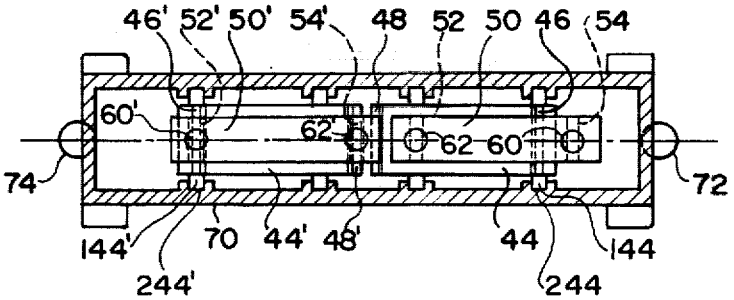
FIG. 7 is a view like FIG. 6, except that the intermediate cam members are shown in a relationship which produces alternate printing.

As previously stated, the device of this invention is also capable of printing alternate areas, one during each direction of platen carriage motion. FIG. 7 illustrates this form of the invention, and, while it appears generally similar to FIG. 6, it will be noted that the right hand intermediate or slidable cam member 44 has been reversed end-for-end so that its cam lobes 46 and 48 are no longer in opposition to the cam lobes 52 and 54. Accordingly the right hand platen 32 will be raised when the platen carriage is in home position. On the first stroke as the platen carriage departs its home position the platen 34 will take an impression at area 14 and proceed until the follower 74 strikes cam 78. This shifts the cage 70 to the right with the result that the cam positions in FIG. 7 are reversed, the lobes on cam member 44' now being out of register with the lobes on cam member 50', and the lobes on cam member 44 being moved into register with the cam lobes on member 50. Then, when the platen carriage is moved through its return stroke, the right hand platen 32 will be lowered and will take an impression at area 12, while the left hand platen 34 will be raised and will not cause an impression to occur at area 14.

In order to achieve such convertability without using substitute parts, either the actuator cage 70 will need an alternate set of guide slots offset from the slots 244 by a distance equal to the throw of the cage, or else a special design of the positions of ears 144 will be needed so as to cooperate differently with a single set of guide slots 244 when the cam member 44 is turned end-for-end. In the preferred form of the invention illustrated in this application, the latter principle has been adopted, and the algorithm defining the special relationship necessary is as follows.

The ears on one side of the movable cam member 44 must have the same spacing as the ears on the other side. The appropriate spacing and location can be determined by randomly selecting a spacing and location for the ears on one side of the slidable cam member, and defining matching slot locations with the cam lobes opposed to those of the fixed cam member. Then the slidable cam member can be turned end-for-end and its cam lobes placed out of register with the fixed cam lobes by an amount equal to the cage throw. The new position of the previously positioned ears will now define the proper location of the slots for the second side of the slidable cam member, while the previously defined slot locations will determine the ear locations on the remaining side of the slidable cam member.

An example of one such relationship which is particularly simple and easy to construct is illustrated in the drawing wherein one of the ears on each side of the slidable cam member is aligned with one of the cam lobes, and the other two ears are aligned with each other but are displaced from the second cam lobe towards the first pair of ears by a distance equal to the throw of the actuator cage. The position of the cage slots is, of course, made to correspond with the ear locations.

While the foregoing explanation has been made with particular reference to the slidable cam member 44 as being the transition device, i.e. the agent for converting the machine from one type of operation to the other, it will be understood that the principle could be applied with equal effect by having one or the other of the fixed cam members 50, 50' and its recesses 60, 62 or 60'. 62' designed to cooperate with adjusting screws 56, 58 or 56', 58' in a similar manner to that outlined for the slidable cam members, in which case the fixed cam member would constitute the transition device.

In either case, the transition device and the cooperating orientation features between it and the cage or platen carriage frame may be described as including "means providing interrelated alternate offset spacial relationships," and when such expression is used hereinafter, only arrangements consistent with the immediately foregoing description are to be considered as defined by this language.

What is claimed is:

1. An imprinter comprising:

a bed;

a platen carriage guidingly associated with the bed for motion along the same;

first and second roller platens mounted on said carriage for rotary motion, each about its axis;

translating means responsive to carriage position for lowering and raising of said platens toward and away from the bed as the carriage is moved along the bed; said translating means including a transition means manually movable from a first position to a second position with respect to said platen carriage for converting the operation of the imprinter from (a) a first mode wherein the first and second roller platens are both lowered towards the bed during movement of the carriage in a first direction along the bed and both raised away from the bed during movement of the carriage in a direction opposite the first direction to (b) a second mode wherein the first roller platen is lowered toward the bed and the second roller platen is raised away from the bed during carriage movement in said first direction and the first roller platen is raised away from the bed and the second roller platen is lowered toward the bed during carriage movement in said opposite direction.

2. An imprinter as set forth in claim 1 in which each platen is rotatable on a shaft mounted in an independent translatable carrier, and in which the translating means comprises coacting fixed and slidable cam members for each carrier and means responsive to carriage position for sliding said slidable cam member, said fixed cam member being fixed with respect to the platen carriage and said slidable cam member being slidable with respect to the fixed cam member in a direction normal to the direction of carriage travel and operatively cooperating with the translatable carriers so that the platens are lowered toward and raised from the bed in response to sliding movement of the slidable cam member with respect to the fixed cam member during carriage movement in said first and opposite directions.

3. An imprinter as set forth in claim 2 in which the transition means comprises one of said slidable cam members.

4. An imprinter as set forth in claim 1 in which each platen is rotatable on a shaft mounted in an independent translatable carrier, and where the translating means controls the motion of said carriers towards and away from the bed, said translating means including an activating device for activating the translating means in response to the carriage position and coacting cam members, one a shiftable member releasably interlocked with said activating device, and the other a fixed cam member releasably interlocked with said platen carriage.

5. An imprinter comprising:

a bed;

a platen carriage guidingly associated with the bed for motion along the same;

a pair of platen carriers mounted upon the carriage;

means on the carriage providing for guided motion of the platen carriers towards and away from the bed surface;

a pair of shafts respectively carried by said carriers;

a pair of roller platens respectively rotatable on said shafts; and means for lowering and raising said platen carriers to place the platens carried thereby in printing or nonprinting position, said means including:

a pair of cam means mounted on the carriage for sliding motion normal to the direction of carriage travel, said platen carriers respectively being disposed beneath and cooperating with the pair of cam means so that each platen is moved to one of said printing and nonprinting positions in response to said pair of cam means being moved in a predetermined direction;

activating means responsive to the position of the carriage along the bed for causing motion of the pair of cam means in said predetermined direction, each of said cam means being independently vertically slidably mounted with respect to the activating means; and means for adjusting the respective heights of the cam means and the roller platens with respect to the bed to thereby adjust the respective clearances between the roller platens and the bed when the platens are in printing position, where independent height adjustment for each roller platen is facilitated due to the independent slidable mounting of each cam means with respect to the activating means.

6. An imprinter as set forth in claim 5 in which the activating means comprises a slide member operatively associated with said pair of cam means and shiftable in a direction parallel to the motion of the pair of cam means, said activating means including cam follower means which travel in a path adjacent the bed in response to said platen carriage being moved along the bed, and activating cams mounted on said bed in the path of said cam follower means at locations where platen lowering and raising are to occur.

7. An imprinter as set forth in claim 5 in which each of said pair of cam means comprises a slidable cam member having two cam lobes directed upwardly away from its associated roller platen, and in which the means for lowering and raising the platen carrier further includes a pair of non-slidable cam members respectively associated with the pair of slidable cam members, each non-slidable cam member having lobes directed downwardly towards its associated platen carrier, the lobes on each said non-slidable cam member being arranged to permit either simultaneous opposition with the lobes of the slidable cam member or a simultaneous out-of-register condition.

8. An imprinter as set forth in claim 5 in which each of said pair of cam means comprises a slidable cam member having two cam lobes directed upwardly away from its associated roller platen, and in which the means for lowering and raising the platen carrier further includes a pair of non-slidable cam members respectively associated with the pair of slidable cam members, each non-slidable cam member having lobes directed downwardly towards its associated platen carrier, the lobes on each said non-slidable cam member being arranged to permit either simultaneous opposition with the lobes of the slidable cam member or a simultaneous out-of-register condition; and further in which the activating means comprises a slide member operatively associated with the pair of slidable cam members and shiftable in a direction parallel to the motion of the pair of slidable cam members, said activating slide member including cam follower means which travel in a path adjacent the bed in response to said platen carriage being moved along the bed, and activating cams mounted on said bed in the path of said cam follower means at locations where platen lowering and raising are to occur.

* * * * *